US005474512A

United States Patent [19]

Belfry

[11] Patent Number: 5,474,512

[45] Date of Patent: Dec. 12, 1995

[54] MOBIL RESISTANCE EXERCISER WITH A REGULATABLE HYDRAULIC RESISTANCE PRESSURE

[76] Inventor: Wayne T. Belfry, 4100 Andy's Ln. #49, Allen, Tex. 75002

[21] Appl. No.: 77,925

[22] Filed: Jun. 18, 1993

[51] Int. Cl.[6] ..... A63B 21/008

[52] U.S. Cl. ..... 482/113; 482/111; 482/119

[58] Field of Search ..... 482/111, 112, 482/113, 114, 115, 118, 119, 73, 63; 273/55 R, 55 A

[56] References Cited

U.S. PATENT DOCUMENTS 3,907,291 9/1975 Parker ..... 273/55 R
4,291,872 9/1981 Brilando et al. ..... 482/63
4,928,957 5/1990 Lanier et al. ..... 482/73
5,013,039 5/1991 Cole ..... 273/55 R

*Primary Examiner*—Richard J. Apley
*Assistant Examiner*—Lynne A. Reichard

[57] ABSTRACT

A Mobil Variable Hydraulic Resistance Exerciser which allows a user to be in motion throughout the complete exercise movement. This exercises the muscles of the feet, ankles, knees, hips, spine, legs and trunk of the body by providing a constant resistance to the user while in motion. A variable hydraulic reservoir is used to regulate the amount of resistance applied thru the Mobil Exerciser.

4 Claims, 9 Drawing Sheets

MOBIL RESISTANCE EXERCISER WITH A REGULATABLE HYDRAULIC RESISTANCE PRESSURE

BACKGROUND OF THE INVENTION

Contact sports and similar activities subject the feet, ankles, knees, hips and spine to great stress and frequent injury. Most exercises are accomplished while standing or sitting in one spot and the user moves the weights or stretches something to work the desired muscle groups. The existing Threadmill Machines only allow the user to walk in place with no load imposed on the user. The best way to exercise is by walking and using all of the muscle groups at the same time under load. The mobil exercising machine accomplishes this by allowing the body to move under a controlled resistant load, thereby strengthing the joint muscles. Muscle strength around joints enhance the joints stability and ability to withstand stress. This is particularly important in contact sports where a high incidence of lower body injuries occur.

SUMMARY OF THE INVENTION

The Mobil Variable Resistance Exerciser of the present invention comprises a track mounted wheeled sled which carries a controlled hydraulic resistance system which is moved along a track by body strength and motion. The mobil exerciser provides a constant resistance to muscle action and muscle groups. This regulation of the amount of resistance applied permits the user to achieve a training effect as well as to provide the means of rehabilitating an injury to the lower body. The Mobil Variable Resistance Exerciser should prove to be very beneficial for rehabilitation of the feet, ankles, knees and hips after an injury or surgery. Muscle pulls and sprains should also respond very well to this therapy.

BRIEF DESCRIPTION OF THE DRAWINGS

FIG. 1—Shows an overall picture of what the track mounted exerciser looks like.

DESCRIPTION OF THE PREFERRED EMBODIMENT

Figure 1:
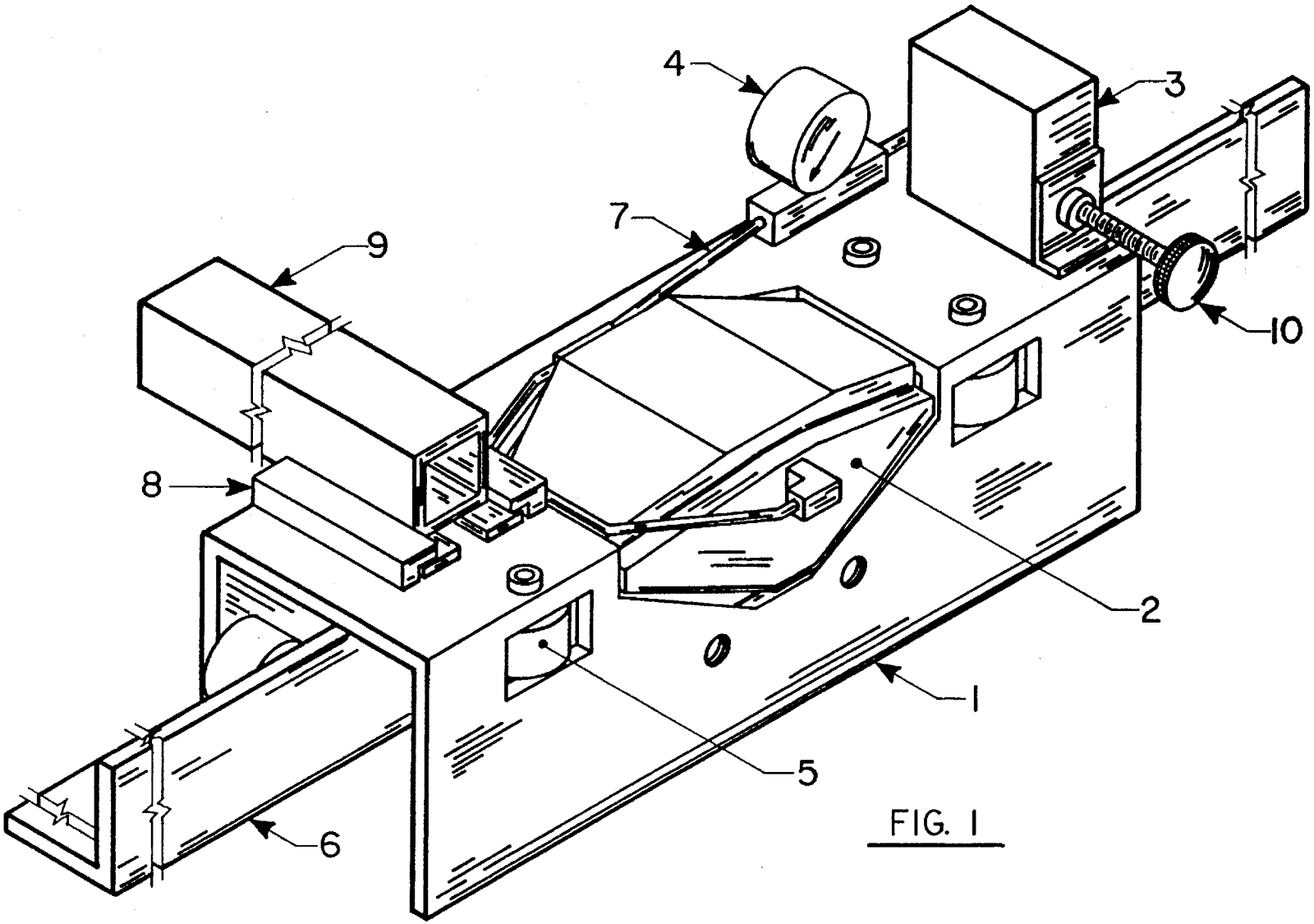
Figure 4:
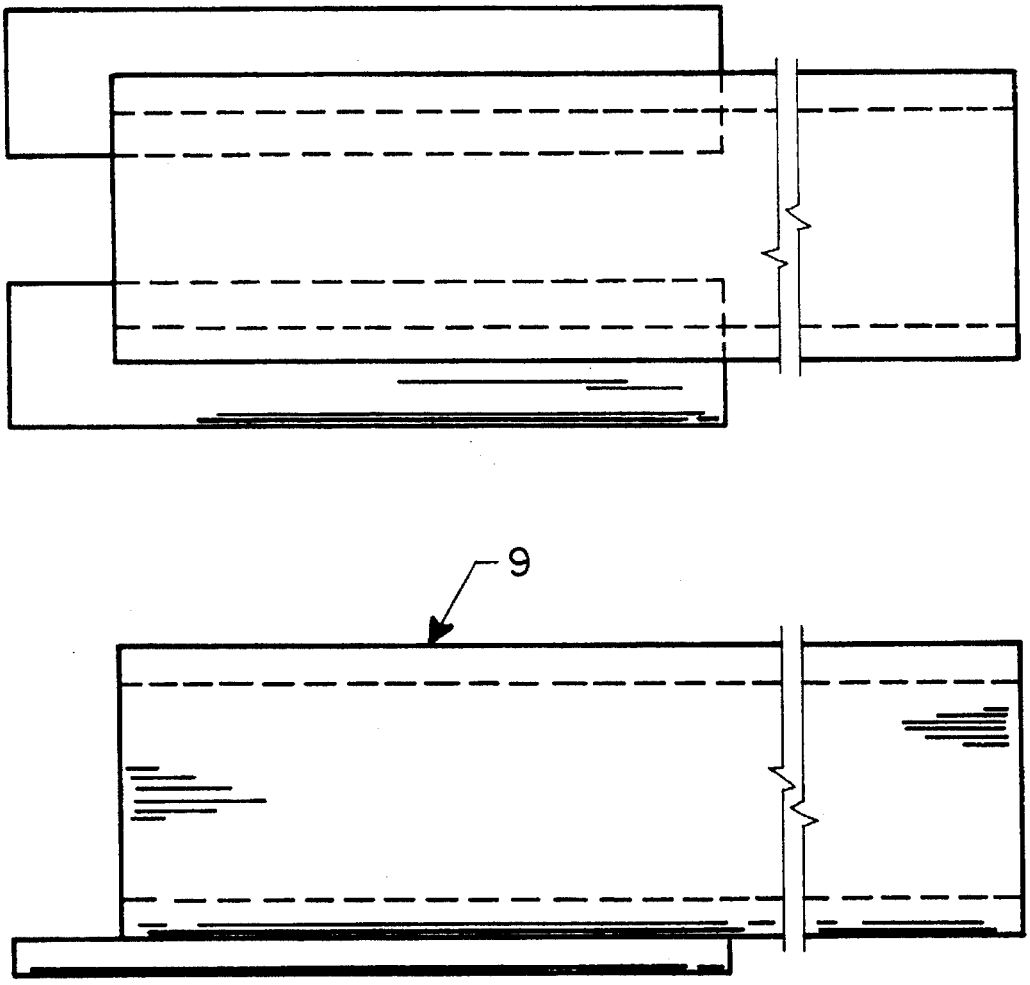
FIG. 4—This is a view of the handle or extension, called a Power Arm.
Figure 5:
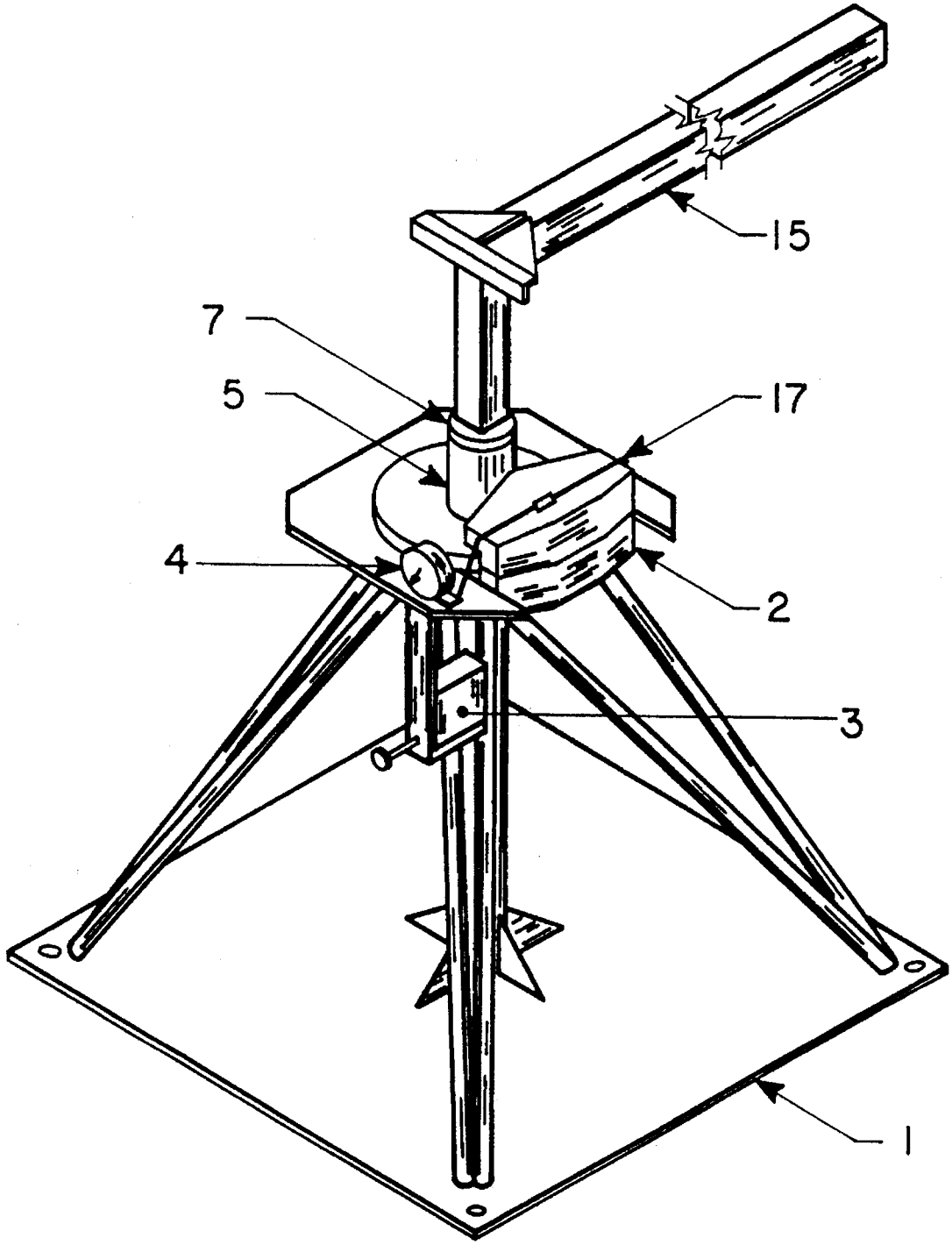
Figure 6:
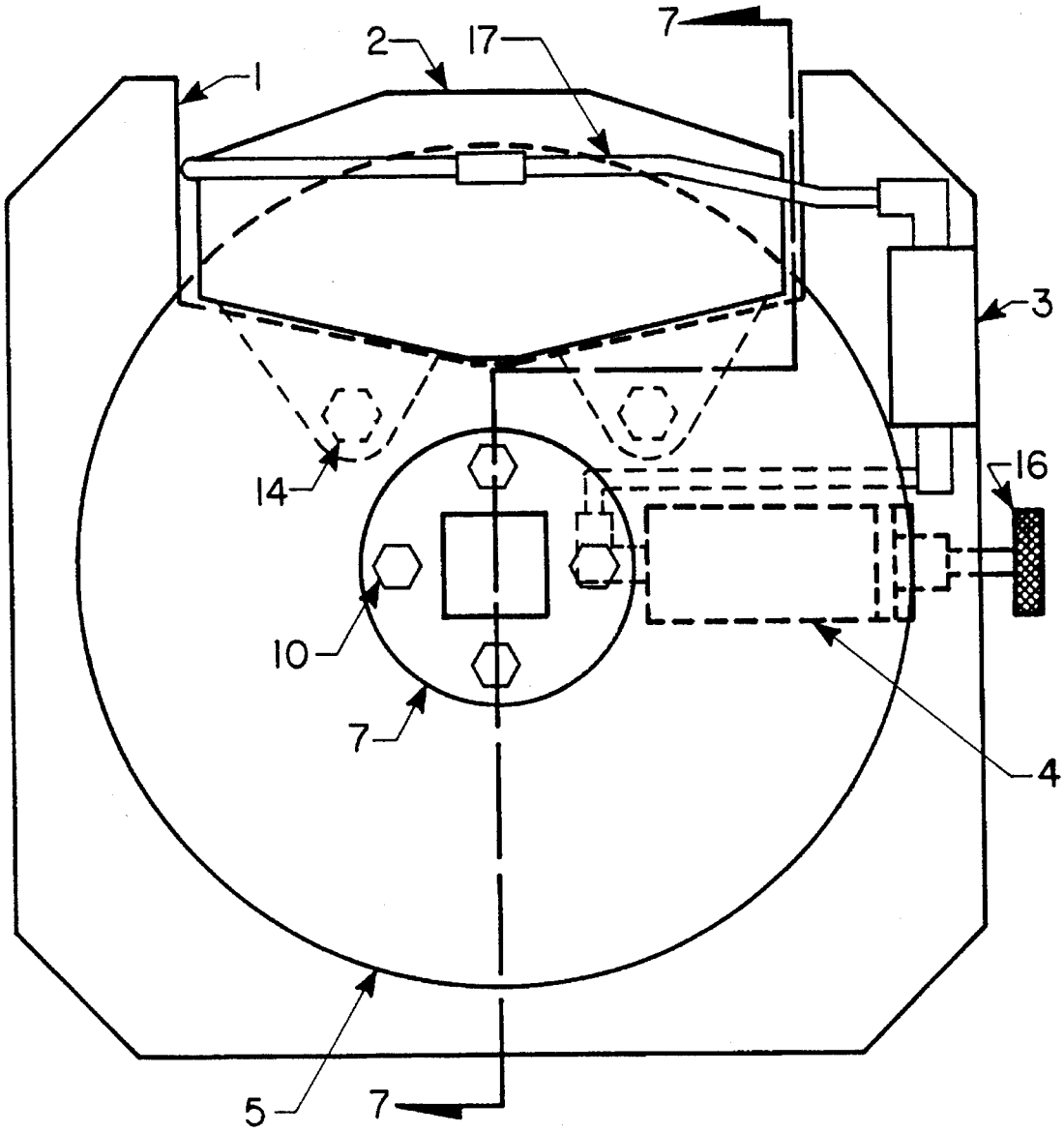
Figure 7:
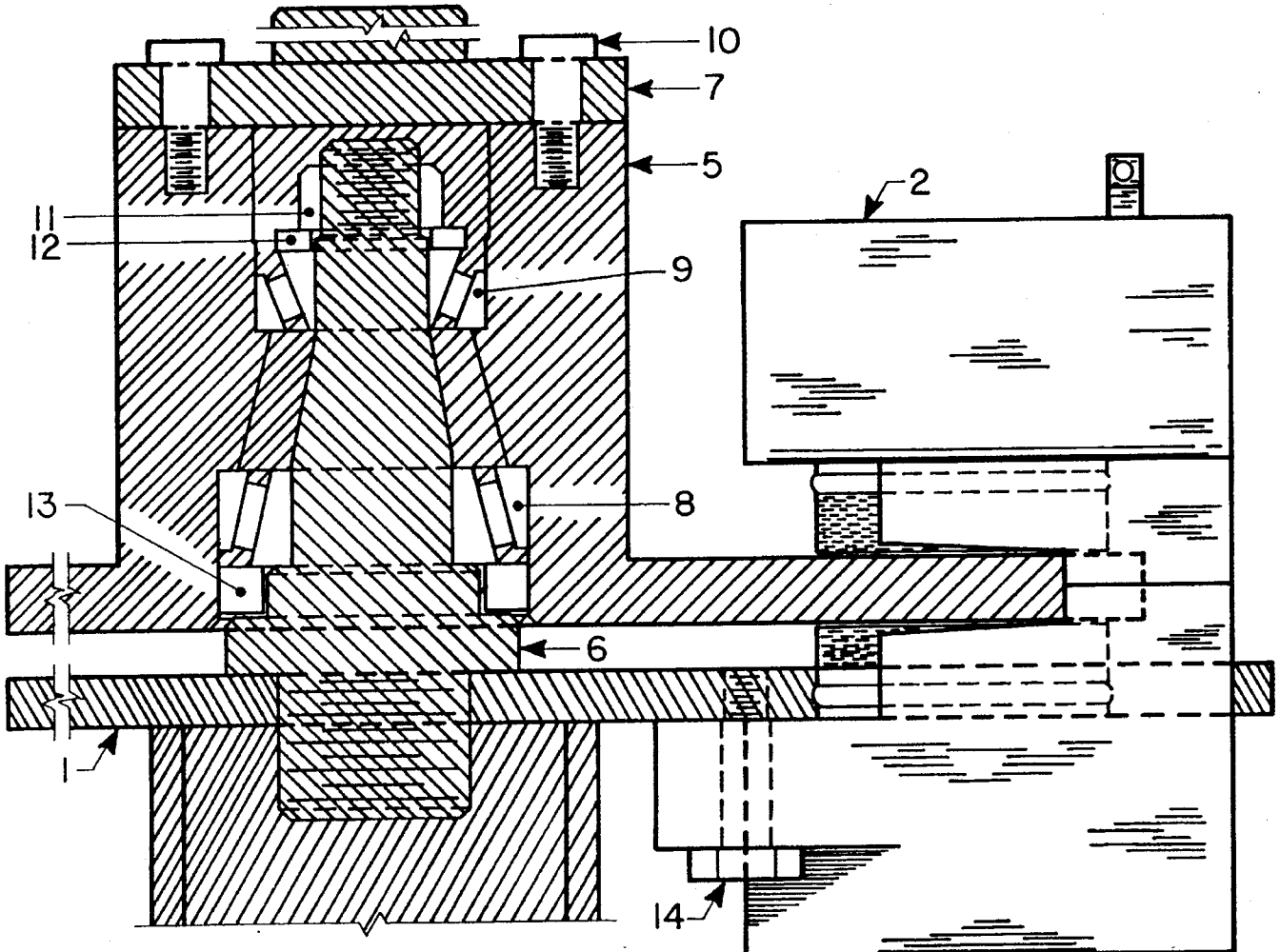
Figure 8:
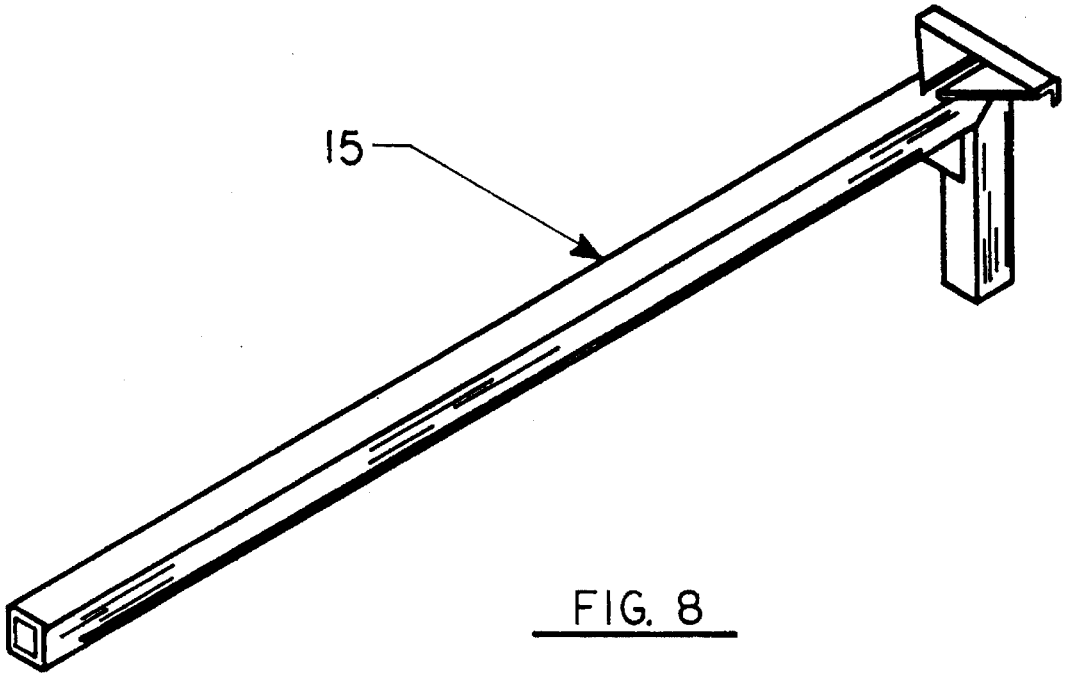
Figure 9:
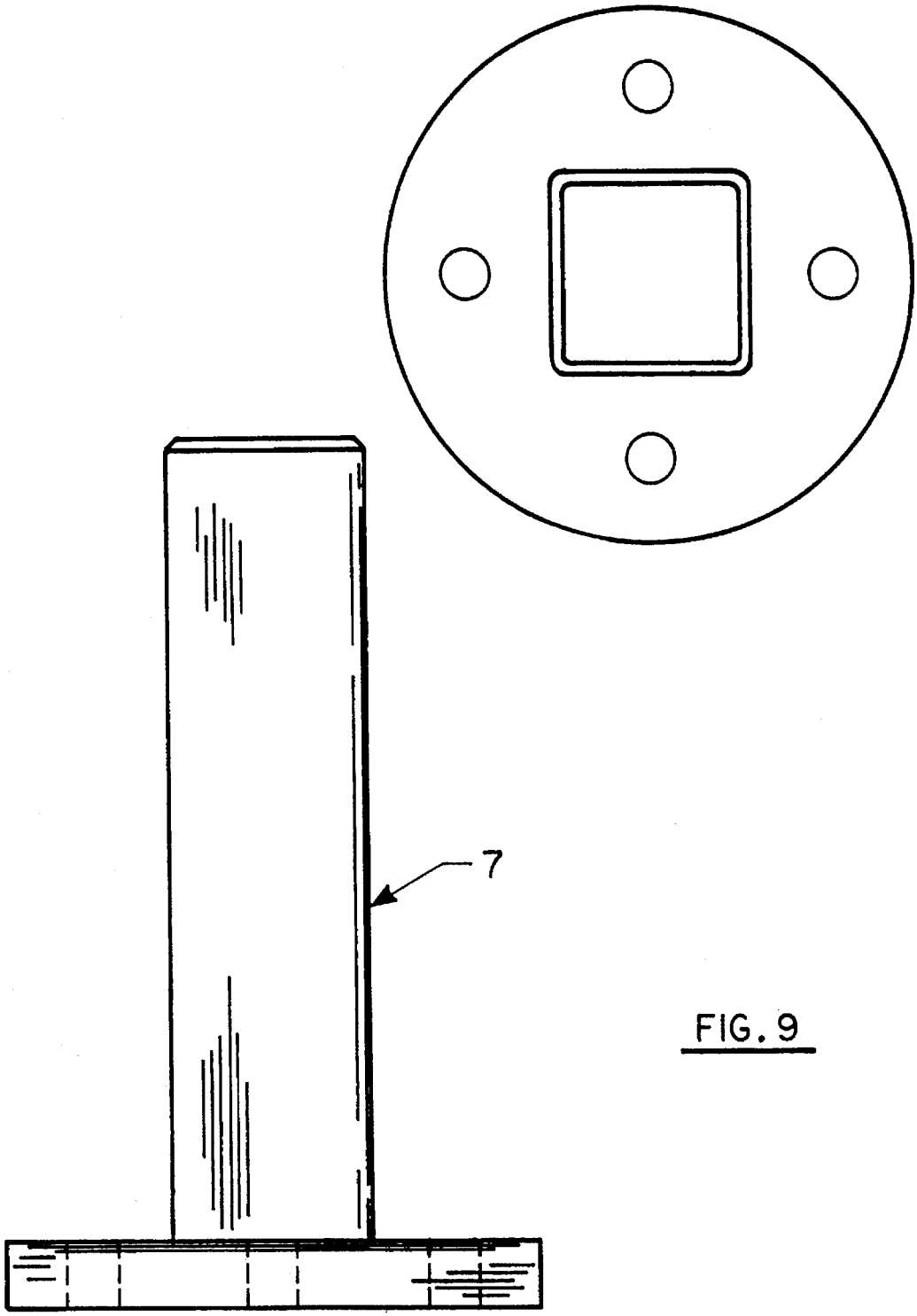

Keeping the design of the exerciser as simple as possible, the preferred embodiment of the Variable Hydraulic Resistant Exerciser herein illustrated consists of an immobile Track, 6, with a moveable sled mounted on it using Plastic Wheels & Bearings, 5, for mobility and a hydraulic braking system for creating resistance against the Track, 6, (FIG. 1). The sled is moved along the Track, 6, by the user's own body strength pushing on a Power Arm, 9. The Power Arm, 9, is a 0.250"×2.0"×2.0" square steel tubing 4 feet in length with two 0.250"×1.0"×5.0" steel pieces welded in place,(FIG. 4). This assembly is slid into two steel Retainers, 8, located on the top of the sled and is perpendicular to the steel Track, 6. The Power Arm, 9, being perpendicular to the Track, 6, allows the user to push against the Power Arm, 9, by walking. This moves the sled down the Track, 6, at a preselected resistant rate that is measured in Pounds Per Square Inch (P.S.I.) by the Meter, 4, installed in the Hydraulic Lines, 7. The Track, 6, is a 0.3750"×3.0"×3.0" stainless steel angle iron, 20 feet in length, and can be assembled with as many 20 foot lengths as desirable. The lengths of track are put together in the normal manner of welding or with bolts. The Track, 6, is mounted 42" high and can be used for inside or outside exercising using any normal method of setup.

DESCRIPTION OF THE PREFERRED EMBODIMENT

Figure 2:
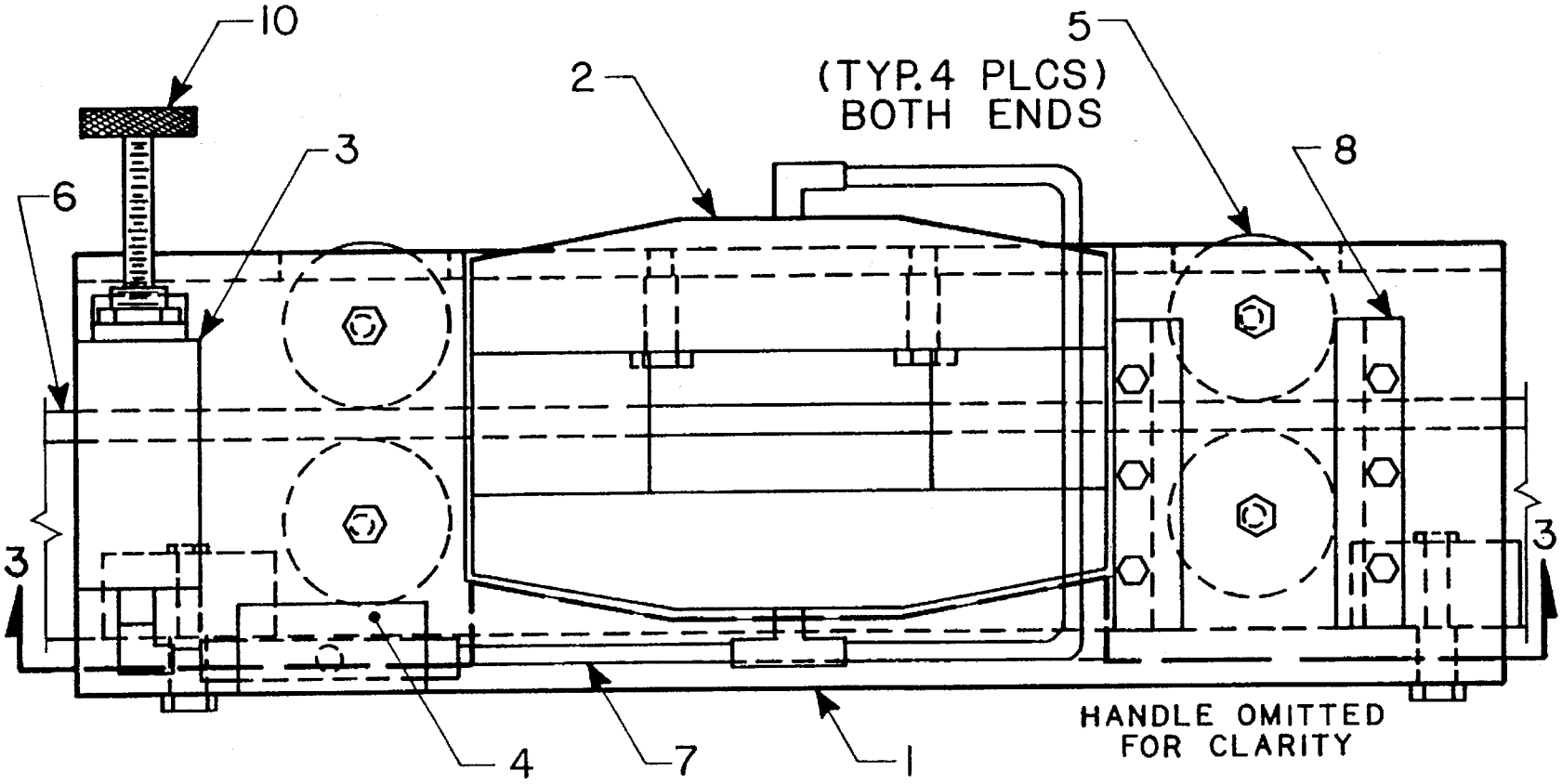
FIG. 2—The top view shows all surfaces of the interior and exterior planes of this embodiment from above.
Figure 3:
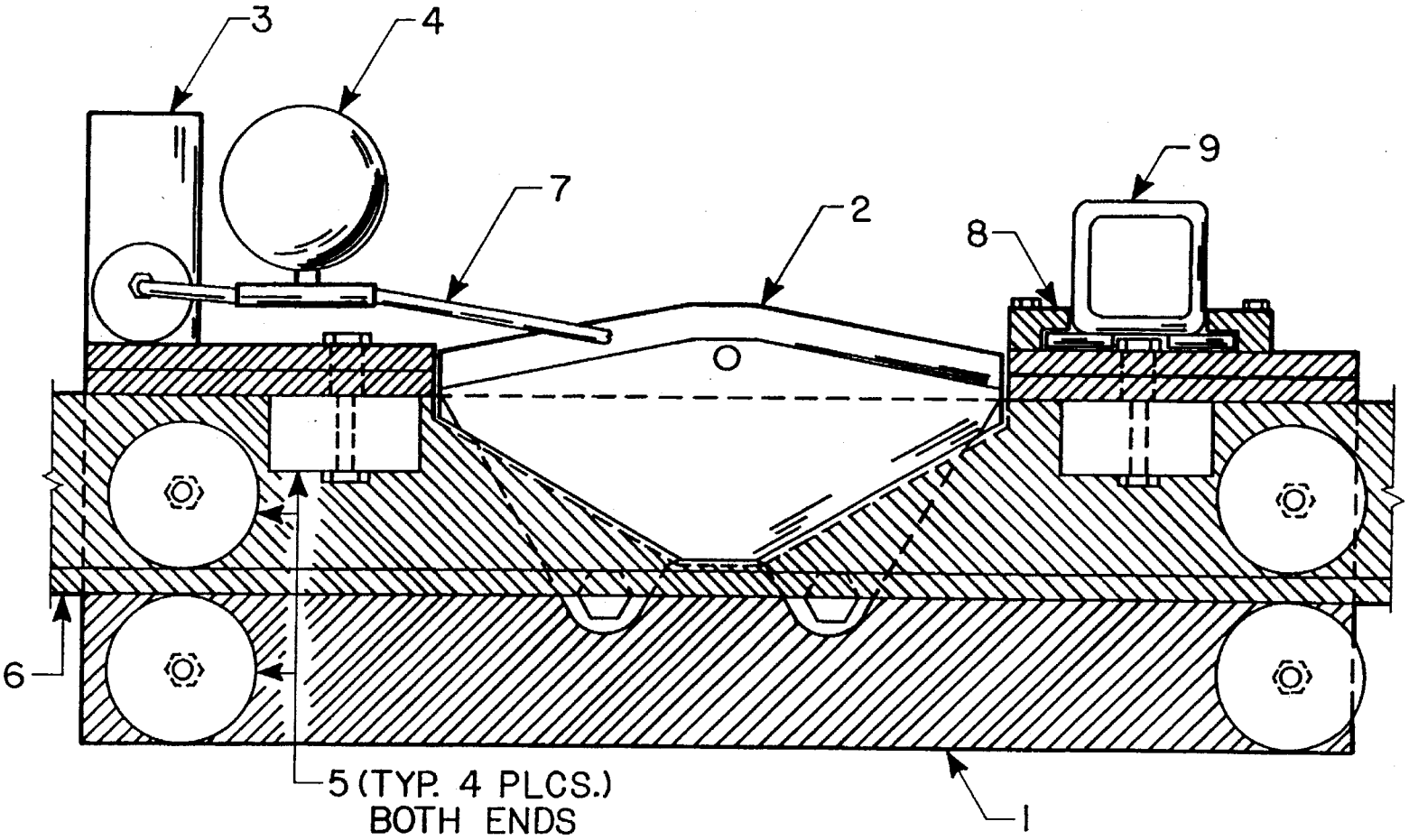
FIG. 3—Sectional view "3—3" is a view of the interior construction of this embodiment of a Mobil Variable Resistance Exerciser and how it is mounted on a track.

The sled is made by using 0.3750" steel, constructed into a 6"×6"×18" U-shaped Chassis, 1, with machined out holes for the mounting of the Hydraulic Caliper Brake, 2, and Plastic Wheels & Bearings, 5. The Hydraulic Caliper Brake, 2, is mounted onto the Chassis, 1, using 0.6250" bolts. The Plastic Wheels & Bearing, 5, are mounted onto the Chassis, 1, using steel dowel shoulder screws. All hardware is tighten in a well known manner. The Plastic Wheels, 5, are positioned to support the sled rigidly against the Track, 6, but still allows it to move easily with a minimum amount of user effort. (See FIGS. 1 thru 3). The Variable Hydraulic System uses opposing hydraulic pistons capable of exerting pressure on linings, pads or sets of pads against the Track, 6, creating a resistant to movement to be overcome by the user. The method of choice for creating the braking part of the Variable Hydraulic Braking System is an existing Caliper Brake, 2, available in the market place. In this preferred embodiment, the Caliper Brake, 2, mounted to the Chassis, 1, is connected to the Meter, 4, mounted on the top of the sled, thru a Hydraulic Line, 7, to the Hydraulic Reservoir, 3, also mounted on the top of the sled. Because of the simplicity of this design, any embodiment can be created using these parts. The embodiment can be fixed or mobil depending on the use it is designed for. The only function of the Hydraulic Fluid in the system is to transmit pressure to the Caliper Brake, 2. There isn't any resistance to the fluid movement in this system. By varying the pressure generated by the Hydraulic Reservoir, 3, a variable resistant load to movement is created. This is done with a Adjusting Screw, 10, that can be screwed in and out of the Hydraulic Reservoir, 3, changing the pressure exerted on the Caliper Braking System, 2, which shows up as a Pounds Per Square Inch (P.S.I.) reading on the Meter, 4, and controls the resistant load to be overcome by the users body strength as the sled is moved down the Track, 6, by walking.

It is thought that the invention will be understood from the foregoing description and it will be apparent that various changes may be made in the form, arrangement and construction of the various parts described without departing from the spirit and scope of the invention. Accordingly, the aforedescribed embodiment is intended for the purpose of illustration and not as a limitation.

I claim:

1. An exercise device comprising:

a sled mounted on an elongated substantially linear track for movement thereon;

a substantially horizontal elongated arm mounted on said sled perpendicular to said track for transmitting force applied to the arm by the user to the sled to cause the sled to move along the track; and a variable hydraulic resistance mechanism for resisting movement of said sled along said track, said variable hydraulic resistance mechanism comprising an hydraulic reservoir and a pair of opposing hydraulic pistons operatively connected to said reservoir via a pressure line for applying a resistance force to said track.

2. The device of claim 1, wherein said sled further comprises wheels for slidably mounting the sled on the track.

3. The device of claim 1, wherein the variably hydraulic resistance mechanism further comprises an adjustment screw for adjusting said resistance force.

4. The device of claim 3, wherein the variably hydraulic resistance mechanism further comprises a meter for displaying the amount of resistance applied to the track in pounds per square inch.

* * * * *